US005252859A

United States Patent [19]

Tagney, Jr.

[11] Patent Number: 5,252,859

[45] Date of Patent: * Oct. 12, 1993

[54] JOGGING ELECTRIC CURRENT GENERATOR

[76] Inventor: Lee Tagney, Jr., 1626 N. Wilcox Ave., Los Angeles, Calif. 90028

[ * ] Notice: The portion of the term of this patent subsequent to Feb. 11, 2009 has been disclaimed.

[21] Appl. No.: 993,694

[22] Filed: Dec. 21, 1992

Related U.S. Application Data

[63] Continuation of Ser. No. 829,434, Feb. 3, 1992, which is a continuation-in-part of Ser. No. 521,842, May 9, 1990, Pat. No. 5,087,033.

[51] Int. Cl.[5] ..... F03G 5/02; A63B 19/04; A63B 22/02

[52] U.S. Cl. ..... 290/1 R; 482/2; 482/54; 482/78; 482/84

[58] Field of Search ..... 290/1 R; 482/2, 84, 482/54, 78

[56] References Cited

U.S. PATENT DOCUMENTS

| | | | |
|---|---|---|---|
| 3,057,201 | 10/1962 | Jaeger | 482/2 |
| 3,511,097 | 5/1970 | Corwin | 482/2 |
| 3,765,245 | 10/1973 | Hampl | 482/2 |
| 4,298,893 | 11/1981 | Holmes | 482/2 |
| 4,389,047 | 1/1983 | Hall | 482/2 |
| 4,883,271 | 11/1989 | French | 482/84 |

OTHER PUBLICATIONS

Stewart, Basic Units in Physics, 1949, pp. 306–307.

*Primary Examiner*—A. D. Pellinen
*Assistant Examiner*—Robert Lloyd Hoover
*Attorney, Agent, or Firm*—Robert J. Schaap

[57] ABSTRACT

A jogging electric current generator which comprises a drum-shaped rotatable exercising unit operatively connected to an electric current generator. The drum-shaped unit is constructed so that a jogger can enter the unit and jog for purposes of exercising and also simultaneously therewith generate an electric current through operation of the generator. The jogging generator may be located closely adjacent to a dwelling structure so that one may leave a dwelling structure and immediately enter the jogging generator. The drum-shaped unit may also be constructed so as to operate as a water vane with water being moved during the jogging activity. A hand-held control unit may also be employed by the user of the apparatus.

13 Claims, 6 Drawing Sheets

JOGGING ELECTRIC CURRENT GENERATOR

RELATED APPLICATION

This application is a continuation of my U.S. patent application Ser. No.. 829,434, dated Feb. 3, 1992, entitled "Jogging Electric Current Generator" and which is a continuation-in-part of my co-pending U.S. patent application Ser. No. 521,842, filed May 9, 1990, entitled "Joggenator, now U.S. Pat. No. 5,087,033, dated Feb. 11, 1992.

BACKGROUND OF THE INVENTION

1. Field of the Invention

This invention relates in general to certain new and useful improvements in jogging electric current generators which provide electric current from a generator when a person is jogging therein, and more particularly, to a jogging electric generator of the type which employs a drum-shaped housing enabling a party to exercise and a generator which generates electrical current during the exercising activity.

2. Brief Description of the Prior Art

In recent years, jogging has become a well recognized and important activity for health maintenance. Jogging does impose certain obstacles to the jogger, not the least of which is the fact that the jogger oftentimes does not have a suitable and safe place in which to perform a jogging activity. As a result, joggers oftentimes run in street areas or find it necessary to cross streets at intersections thereof. This, naturally, poses a health hazard and also a potential interference to traffic.

In addition to the above, jogging also presents certain drawbacks, particularly from a health standpoint in that joggers who perform their running activities on hard concrete surfaces may ultimately experience body joint problems, particularly in the knees and ankles. As a result, it would be better to provide an area which is not only safe, but which does not present these health hazards.

Finally, with regard to all exercising apparatus, there is essentially no means provided to perform any useful work. Thus, while the exercising individual is expending substantial energy, that energy is not being converted into another form of energy for ultimate use.

There have been several devices in which an occupant can position himself or herself in a housing for causing movement and particularly rotatable movement of that housing. One such device which is adapted for use in water is described in U.S. Pat. No. 2,838,022 to Wilson. Another type of device in which an occupant can use foot skates is taught in U.S. Pat. No. 3,622,179 to Pfersick. A occupant-propelled gyral wheel is disclosed in U.S. Pat. No. 2,953,394 to Anderson. Finally, a rotatably supported playground barrel is taught in U.S. Pat. No. 3,536,324 to Aherns. However, there has not been any device in the prior art which effectively allows an individual to jog and simultaneously therewith generate electrical power, particularly where there is a variety of control features available.

OBJECTS OF THE INVENTION

It is one primary object of the present invention to provide a jogging electric current generator which enables the generation of electrical current on a highly efficient basis while a user performs a jogging activity.

It is another object of the present invention to provide a jogging electric generator of the type stated which is highly effective in its operation and which includes a drum-shaped housing connected to an electric current generator which provides electric current therefrom.

It is an additional object of the present invention to provide a jogging generator of the type stated which can be used in conjunction with a dwelling structure so that the user thereof can enter and exit the dwelling structure directly into and out of the jogging generator housing unit.

It is still another object of the present invention to provide a jogging electric current generator of the type stated which utilizes vanes on the exterior thereof to operate as a type of water wheel and which permits operation with circulating water through a circulating system.

With the above and other objects in view, my invention resides in the novel features of form, construction, arrangement and combination of parts presently described and pointed out in the claims.

SUMMARY OF THE INVENTION

The present invention comprises a jogging electric current generator which includes a drum-shaped housing unit supported on on a suitable supporting structure. In accordance with this construction, an individual can enter the drum-shaped housing and perform a jogging activity while remaining in a generally stationery position.

An electric current generator is connected to the drum-shaped unit and forms part of the exercising apparatus and is capable of generating electric current while the jogging individual performs a jogging activity. Any type of electric current generator can be employed for this purpose. Further, by using suitable electrical switching devices, such as rectifiers and the like, it is possible to produce both AC or DC electrical current.

The exercising unit, in a preferred embodiment, can be located very closely adjacent to a dwelling structure such as a person's place of residence. In this way, the user can merely exit his or her dwelling structure and step directly into the drum-shaped unit housing. The same exercising individual may also easily exit the drum-shaped unit housing in essentially like manner.

In another embodiment of the present invention, the drumshaped housing is provided with water vanes circumferentially spaced around its annular surface. A pumping mechanism is provided for pumping water to a trough located above the drum-shaped housing. The water spills into the slots between each of the vanes. The water is allowed to flow out of the slots through elongate openings on the sides of each of the slots. Thereafter, the water is collected into a sump and recycled to perform a continuous operation.

The jogging generator of the present invention is also constructed so that a plug in connector can be operatively connected to the generator. Further, the electric power generated by using this jogging generator can be used for charging storage batteries or the like.

The present invention is provided with a control means which may adopt several forms as, for example, a passive control means or an active control means. In the embodiment of the invention where the control means is active, this control means may affect a parameter of the jogging generator based on a physical characteristic of a jogger. As an example, the weight of the jogger can be sensed and the frictional force imposed on the drumshaped exercise unit housing can be altered in response thereto. As a more passive type of control means, a display member may be provided for generating readable display regarding information about the jogging generator. Further, the control means may adopt the form of manually actuable switch means operable by a user of the apparatus. In a more preferred embodiment, the switch means could be incorporated in glove devices which are used by the jogger.

This invention possesses many other advantages and has other purposes which will become more fully apparent from a consideration of the forms in which this invention may be embodied. One of these forms is more fully illustrated in the accompanying drawings and more fully described in the accompanying detailed description of this invention However, it should be understood that these drawings and the detailed description are only set forth for purposes of illustrating the general principles of the invention and are not to be taken in a limiting sense.

BRIEF DESCRIPTION OF THE DRAWINGS

Figure 1:
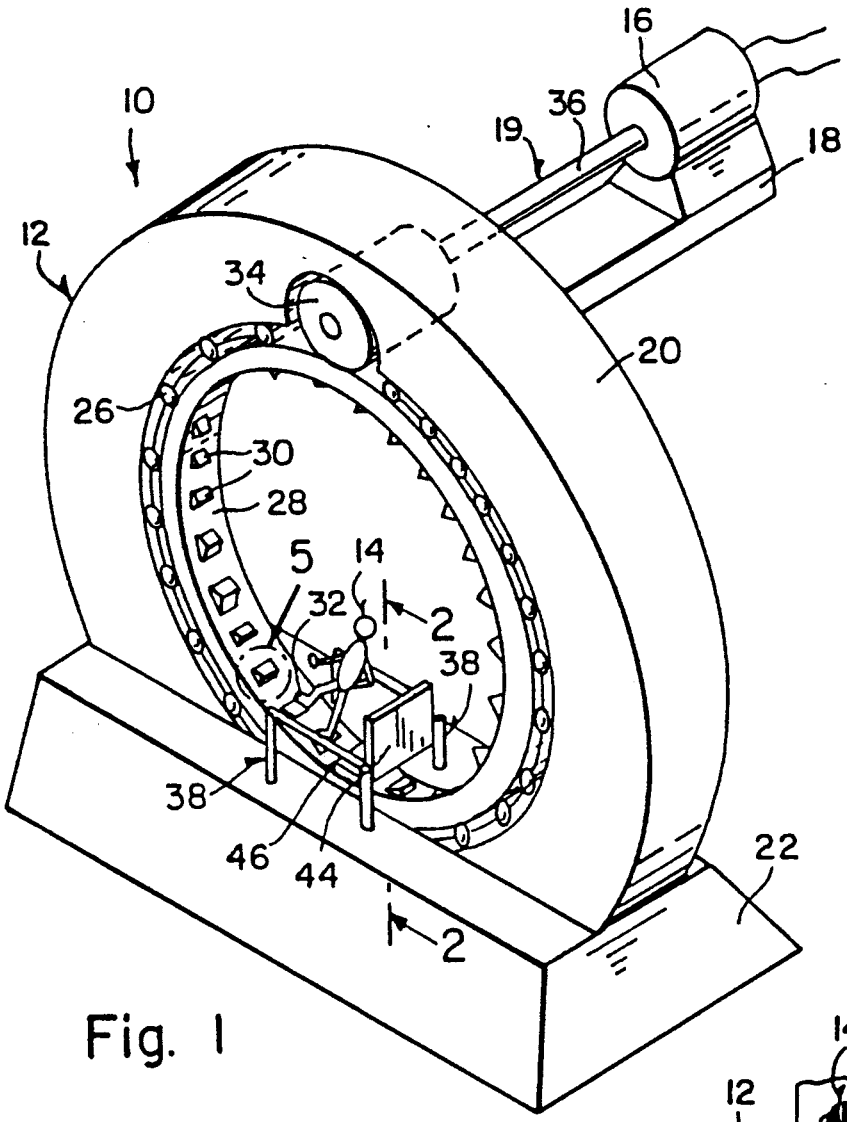
Figure 1A:
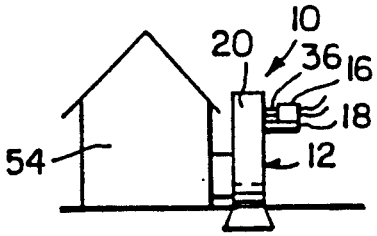
Figure 2:
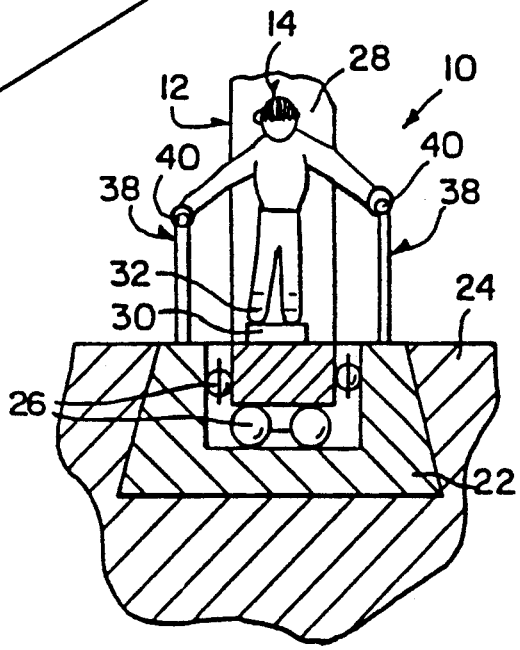
Figure 3:
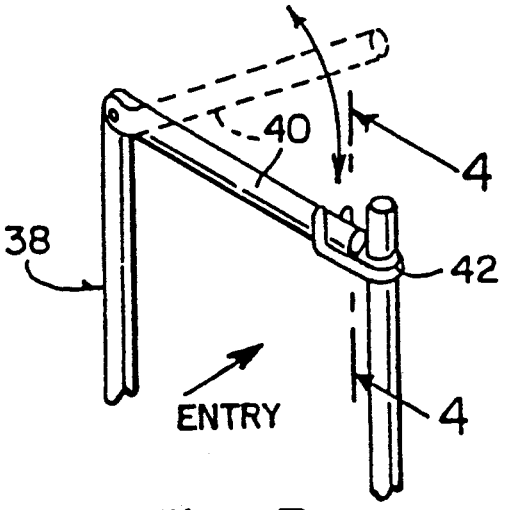
Figure 4:
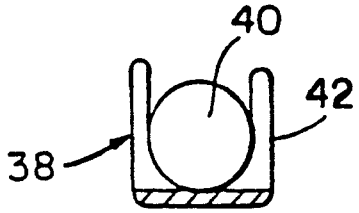
Figure 5:
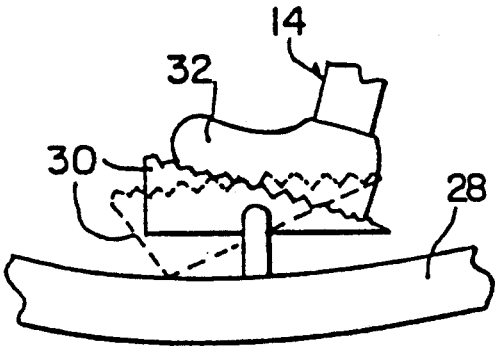
Figure 6:
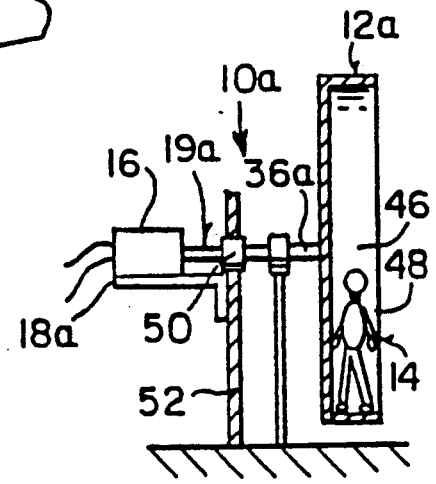
Figure 7:
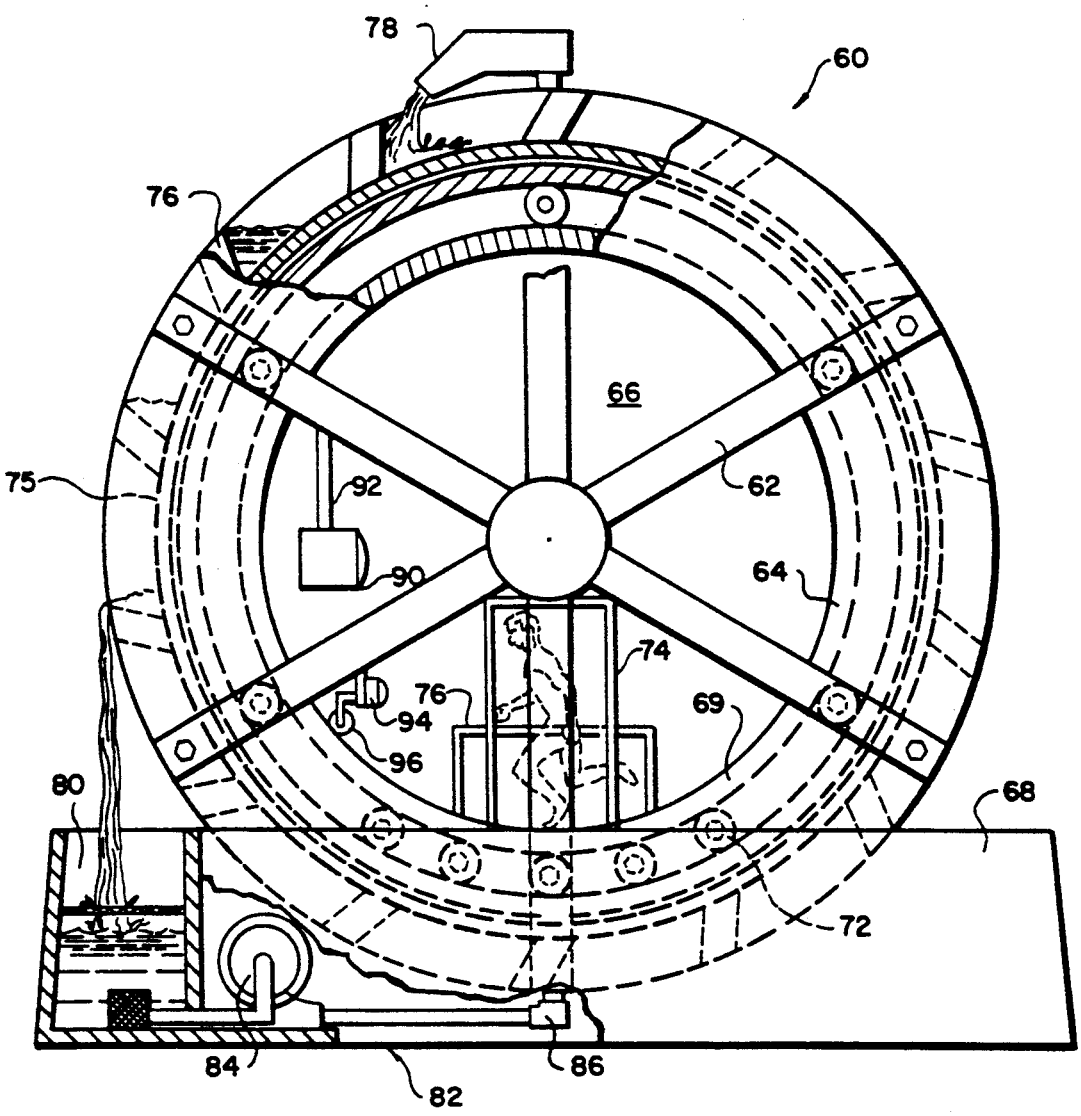
Figure 8:
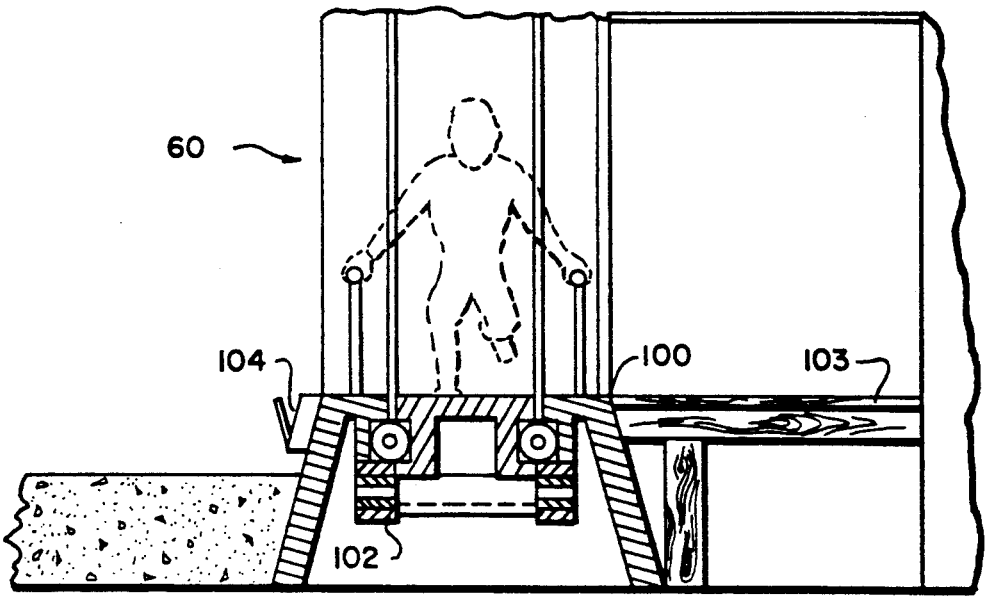
Figure 9:
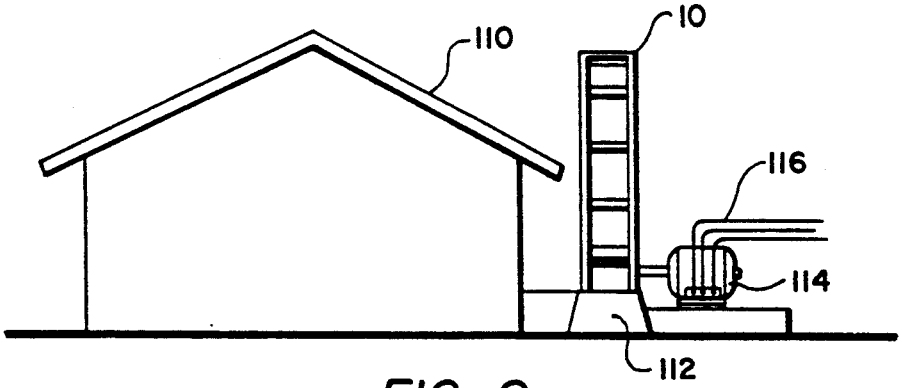
Figure 10:
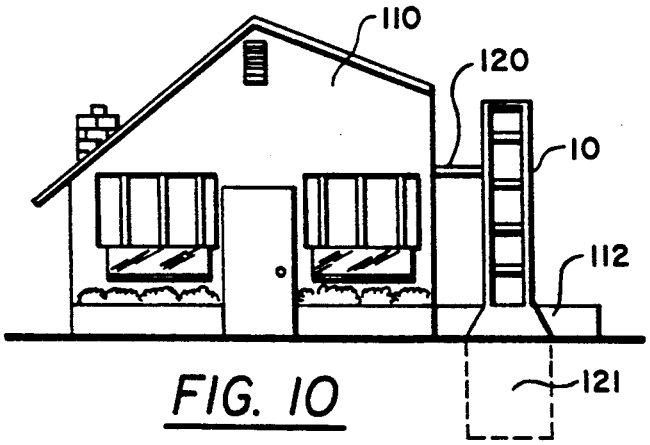
Figure 11:
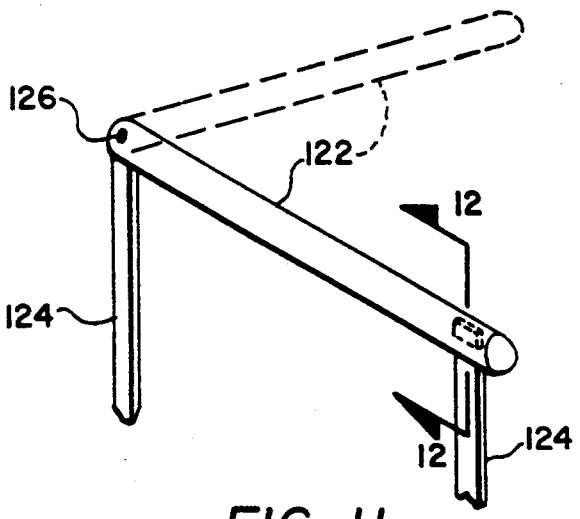
Figure 12:
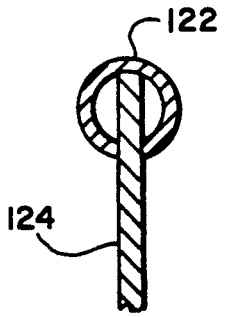
Figure 13:
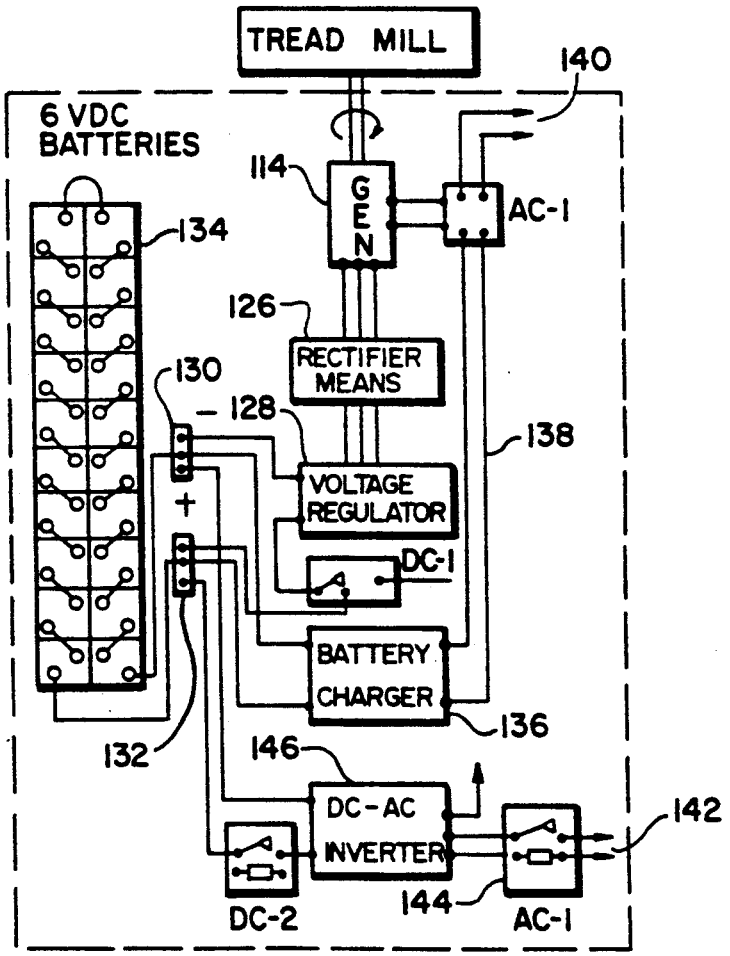
Figure 14:
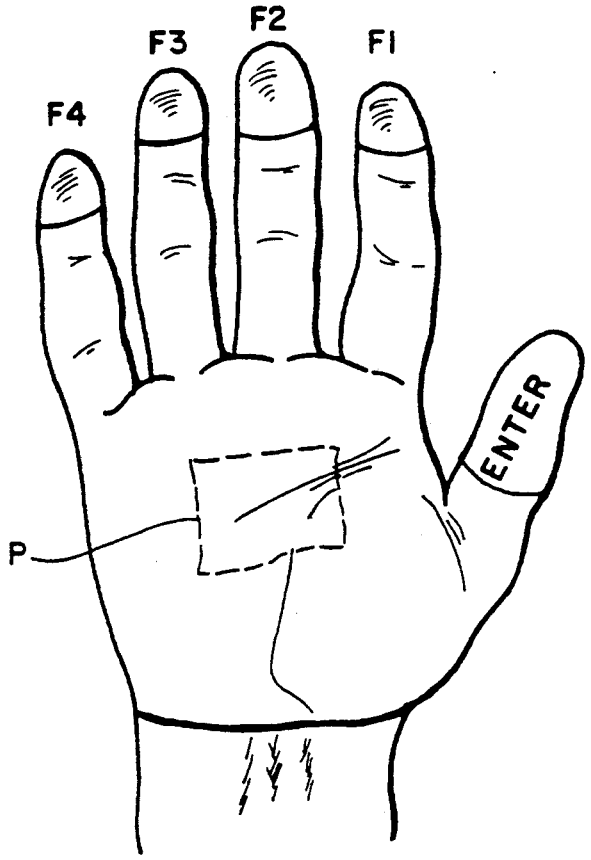
Figure 15:
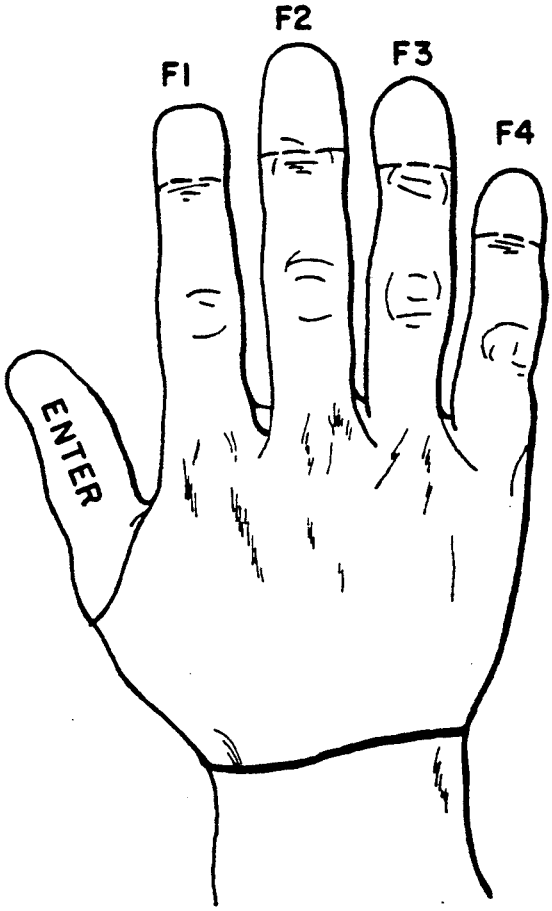

Having thus described the invention in general terms, reference will now be made to the accompanying drawings in which:

FIG. 1 is a perspective view of a jogging generator constructed in accordance with and embodying the present invention and showing a person jogging in a rotating ring to operate a generator;

FIG. 1A is a diagrammatic view showing a house with access to an adjacent jogging generator;

FIG. 2 is a fragmentary vertical view taken substantially along line 2—2 of FIG. 1;

FIG. 3 is a perspective view of one of the access gates and support bars forming part of the jogging generator;

FIG. 4 is a vertical sectional view taken along line 4—4 of FIG. 3 and showing the bracket forming part of the access gates in more detail;

FIG. 5 is an enlarged fragmentary side elevational view of a treadle step in the rotatable ring of the jogging generator with a jogger's foot thereon;

FIG. 6 is a side elevational view of a modified form of jogging generator in which the generator portion may be located in a building and with the drum-shaped housing located exteriorly of the structure;

FIG. 7 is a side elevational view of another modified form of jogging generator constructed in accordance and embodying the present invention and showing the use of recirculating water in connection therewith;

FIG. 8 is a fragmentary front elevational view of one embodiment of a jogging generator adjacent to a portion of a dwelling structure;

FIG. 9 is a front elevational view of a jogging generator in a position adjacent to a dwelling structure;

FIG. 10 is a front elevational view of a jogging generator adjacent to a dwelling structure and showing a covered access way leading to and from the interior compartment of the jogging generator;

FIG. 11 is a modified form of side access gate forming part of a jogging generator of the present invention;

FIG. 12 is a vertical sectional view taken along line 12—12 of FIG. 11;

FIG. 13 is a schematic electrical view showing one form of electrical circuitry which can form part of the jogging generator of the present invention;

FIG. 14 is the palm side of a control glove used in and forming part of the jogging generator; and FIG. 15 is the back side of a control glove forming part of and used in the jogging generator of the present invention.

DETAILED DESCRIPTION OF PREFERRED EMBODIMENTS

Referring now in more detail and by reference characters to the drawings which illustrate several preferred embodiments of the invention, there are several views of various proposed embodiments of a jogging generator.

FIGS. 1, 1A and 2 illustrate a jogging generator 10 comprised of a drum-shaped exercise unit 12 sized so that a jogger 14 can run therein. An electric generator 16 is supported on a platform 18 while a mechanism 19 is connected to the drum-shaped exercise unit 12 for operating the generator 16 during the running of the jogger 14 within the exercise unit 12 so as to produce electrical current from the generator 16.

The exercise unit 12 includes a drum housing 20 having a support foundation 22 to be placed onto a flat surface 24, such as the ground or a floor. A ball bearing race 26 is carried within the drum housing 20 while a rotatable ring member 28 is carried on the ball bearing race 26. Adjustable treadles 30 (see FIG. 5) are spaced apart on the ring member 20 to provide a comfortable position for the foot 32 of the jogger 14.

The mechanism 19 includes a friction gear wheel 34 rotatable between the drum housing 20 and the ring member 28 located opposite the support foundation 22. An axle shaft 36 extends from the center of the friction gear wheel 34 to the generator 16. When the jogger 14 runs on the treadles 30 in the ring member 28 the axle shaft 36 will rotate to operate the generator 16.

A pair of access gates 38 are each positioned on each side of the drum housing 20 on the support foundation 22. As best seen in FIGS. 3 and 4, each gate 38 has a pivotable horizontal rail 40 which rests within a bracket 42 so that the jogger 14 can enter therethrough and hold onto both of the horizontal rails 40 when running in place. A seat 44 is provided and has a pair of foot rests. The seat 44 extends across the access gates 38 over the ring member 28 so that the jogger 14 can sit upon the seat 44 and place both feet 32 within the foot rests when not running.

A modification 10*a* is shown in FIG. 6 in which the exercise unit 12*a* is a large drum wheel 46 having an open side 48 so that the jogger 14 can enter to run in place. The mechanism 19*a* is an axle shaft 36*a* which extends from the center of the drum wheel 46 to the generator 16 through a baring 50 in a fixed partition 52, such as a wall of a building. When the jogger 14 runs in the large drum wheel 46 the axle shaft 36*a* will rotate to operate the generator 16. The generator 16 is supported on a platform 18*a* which is attached to the partition 52.

The jogging generator 10 or 10*a* can be designed for either indoor or outdoor installation and can be disassembled for use in different seasons. Optionally, the invention can have an old mill wheel decor added to the exterior of the exercise unit 12 or 12*a* to blend in with the decor of a building 54 (see FIG. 1A) on an outside installation.

An outdoor lighting display can be connected to the electric current while an optional motor can be attached to the ring member 28 or to the gear wheel 34. The invention can also be fabricated out of transparent plastic material to prevent it from looking like a hugh power plant.

FIG. 7 illustrates a modified form of jogging generator which is similar in many respects to the jogging generator of FIG. 1. However, in this embodiment of the jogging generator, a drum-shaped exercise unit housing 60 is provided on the opposite exterior sides thereof with a network of cross ribs 62 forming a main frame. Side walls 64 may be located on the frame to partially or fully enclose the drum-shaped housing 60 and thereby provide an interior compartment on chamber 66. The jogging generator is supported on a platform 68 and includes a rotatable ring 69 for the jogger to engage with his feet during a jogging activity. Further, the rotatable ring 69 is supported on a plurality of roller bearings 72.

In the embodiment of the invention as illustrated in FIG. 7, an access door 74 leads to the interior chamber 66. Moreover, a gated area 76 is also provided in the interior of the chamber 66. This gated area may adopt the form of an access gate of the type shown in FIGS. 3 and 4 or otherwise, it may adopt the form of an access gate hereinafter described in connection with FIGS. 11 and 12.

The jogging generator of FIG. 7 operates in a manner similar to the previously described jogging generator of FIG. 1 and therefore, the operation thereof is not described in great detail. However, the jogging generator of FIG. 7 is provided with an outer ring 75 having a plurality of outwardly extending fins 76 which extend transversely across the drum-shaped housing. The outer ring 75 is supported by additional rollers 77. Water is dispensed from a dispensing trough located at the upper end of the drum-shaped housing. This water will engage the transversely extending fins 76 and will be allowed the drain from slots at the transverse ends of each of these fins or vanes 76. The water which is allowed to drain may be carried by a trough in the drum-shaped housing to a water recovery sump 80.

Water may be recycled from the sump 80 back up to the trough 78 by means of a water recycling system 82. This water recycling system comprises a pump motor combination 84 which pumps water from the sump through a piping system 86 back up to the trough 78.

The water which is allowed to drain over the drum-shaped housing can serve an aesthetic function or it may also perform one or more utilitarian functions. For example, the water can be used readily to cool down the drum-shaped housing in a hot environment as, for example, when exposed to direct summer sunlight. The water can actually be used as a force to jog against in order to provide greater jogging activity.

There is also a possibility of static electricity generation as a result of a jogger performing jogging activities inside of the drum-shaped housing. This static electricity can easily be removed by means of ground wires (not shown) connected to the rotatable ring 69.

Also located within the drum-shaped housing is a computer monitor 90 which is supported on a pair of suspended support rods 92. This computer monitor 90 would be connected to a computer (not shown), which may form part of the system, for purposes of generating a display about conditions in the jogging activity or about other external conditions. For example, the computer could be connected so as to monitor various activities in conjunction with sensors, e.g., rate of speed, amount of force being used, etc. and this information would be displayed on the computer monitor 90. Moreover, the computer monitor could also be used to provide some entertainment value or informational value as, for example, stock market quotes or the like.

Also mounted adjacent the edge of the rotating ring is one or more meters 94 and which may be connected to a sensor such as a small roller 96 riding on the surface of the rotatable ring 69. In this way, other information such as rates of rotation, etc. can be generated and provided on the gages 94.

It is also possible to incorporate a telephone or other communication device within the drum-shaped exercise unit 12 so that a jogger may conduct telephone communications, or other types of communications, while performing a jogging activity. It is also possible to include recording equipment, dictating equipment and the like. For this purpose, a microphone could be conveniently mounted in a suitable location so that the jogger could speak directly into the microphone which may be, in turn, connected to a telephone system or to a dictating system, or the like. Hand controls for operating the microphone and/or the telephonic or dictating equipment could be incorporated in the hand rails located within the drum-shaped exercise unit housing.

FIG. 8 illustrates one form of control means which may be used in the jogging generator and which includes weight sensors 100 which effectively sense the weight of a jogger. These sensors transmit information to a central processor, such as a computer, which, in turn, causes a generation of a signal for controlling friction wheels 102. These wheels 102 are schematically illustrated to bear against the ring 69 within the drum-shaped housing. Thus, the amount of frictional resistance imparted to the drum-shaped housing can be adjusted in accordance with the weight or, for that matter, other physical characteristics of a jogger.

It is also possible to take advantage of the increased energy used by a jogger when the amount of force required by the jogger to perform a jogging activity is increased. This can be easily accomplished by altering the generator, as for example, the position the armature within the field winding of the generator, or otherwise by increasing the number of coils in the winding of the generator. This could have the effect of increasing the amount of force required to rotate the rotatable ring 69 within the drum-shaped housing. Thus, this increased energy used by the jogger would result in additional electrical energy being generated.

The embodiment of FIG. 8 also discloses the drum-shaped housing adjacent to a porch 103 of a dwelling structure. FIG. 1A illustrated the use of the jogging generator adjacent a dwelling structure such as a house 54. FIGS. 9 and 10 also illustrate embodiments of the jogging generator adjacent to a dwelling structure.

The jogging generator of FIG. 8 may also be provided with jumper cables 104 connected to an output system on the output of the generator forming part of the apparatus. These jumper cables could be used for a variety of auxiliary electrical current demands.

Referring now to FIGS. 9 and 10, it can be observed that one form of jogging generator 10 is located directly adjacent to a dwelling structure 110. The jogging generator 10 is located on a foundation support 112 and which also holds a generator 114 forming part of the jogging generator. Output cables 116 may provide an output current to a suitable control member not shown in FIG. 9.

FIG. 10 illustrates an embodiment of the invention where the dwelling structure 110 is located immediately adjacent to a support foundation 112 for holding a drum-shaped housing 10. However, in this embodiment, a covered access way 120 extends between the dwelling structure 110 and the drum-shaped housing 10. In this way, a user of the jogging generator can exit a door in the dwelling structure 110 leading to the covered access area 120 and immediately walk into the drum-shaped housing 10. The same party may also exit the drum-shaped housing through the same covered access way 120. This type of a system is highly effective where the jogging generator is located in conditions where inclement weather is common.

The jogging generator illustrated in FIG. 10 is provided with an underground storage compartment 121 which may be used for housing the electric current generator and like equipment. For that matter, this storage chamber 121 could be used to house the central processing unit of the computer or other types of equipment. Indeed, the components discussed in connection with FIG. 13 (hereinafter described) could also be easily housed within this chamber 121.

FIGS. 11 and 12 illustrate a modified form of a gate assembly which may be used in the chamber 66 of the drum-shaped housing 60. In this case, a plurality of horizontally located rails 122 extend between upstanding posts 124 and form an area for receiving a jogger, usually adjacent to an access door leading into the compartment 66 as, for example, the access door 74. One of the horizontal bars 122 is hingedly connected as shown at 126 so that it can be raised and lowered. The opposite end of this horizontal bar 122 fits over the upper end of another vertically disposed post 124, as best illustrated in FIGS. 11 and 12.

FIG. 13 illustrates one form of circuit which may be used with the jogging generator of the present invention. In this circuit, it can be observed that a generator, such as the generator 114 is connected through a rectifier 126 to a voltage regulator 128 and which is, in turn, connected to sets of contacts 130 and 132. These contacts may be connected to a bank of six-volt batteries or other types of batteries 134. Also connected through the contacts 130 and 132 is a battery charger 136 and which receives power from either the treadmill or from an external source 138. Finally, AC electrical power could be provided at the outputs 140 or, for that matter, at outputs 142 through a switch 144. In this case a DC-AC invertor 146 may be employed.

The jogging generator may also be provided with manually actuable control elements for controlling the condition of the jogging generator and parameters of jogging activities. For example, the jogger may wish to control not only the information which is provided, such as feedback information, but the jogger may also wish to control those parameters which affect the jogging activity as, for example, the amount of frictional force on the rotatable ring against which the jogger exerts a running force. Many of these controls, if not all of the controls, could be easily incorporated within a pair of gloves which are ultimately connected to a control circuit, including the central processor (not shown). Any form of electrical control circuit may actually be used for this purpose and is, therefore, neither illustrated nor described in any detail herein. The design of the control circuit is relatively simple, given the input-output relationships as shown herein, particularly when most of these functions could be easily handled by simple software control.

FIGS. 14 and 15 illustrate the palm side and the back side of one form of control glove which is provided on its palm side with a plurality of fingertip contacts designated as "F1", "F2", "F3" and "F4", respectively, as well as a thumb contact designated as "Enter." These contacts would all be electrically connected so that when operated in predetermined combinations, they would perform certain control functions. As a simple example, contacting the contact F1 to the pad on the inside of the hand designated as "P", would increase the resistance against which the jogger would attempt to operate. contacting the contact F2 to the pad "P" would decrease resistance. Contacting the contact F3 and F4 to the pad "P" would be effective to operate a brake mechanism. Contacting the contact F1 to the "Enter" contact wold unlock and open a safety gate and simultaneously energizing a brake ring lock. Moving the contact F2 into contact with the "Enter" contact would close and lock the safety gate and simultaneously release a ring brake lock (not shown). Bringing the contact F3 into contact with the "Enter" contact would lock the brake and unlock and open the safety gate. In like manner, by moving the contact F3 to the contact "Enter", this would be effective to switch the monitor to different channels and moving the contact F4 to the "Enter" contact may be used to operate other mechanisms such as a telephone, etc.

It can be observed that the above are only a limited number of possible combinations for operating the various contacts. Any form of combinations could be employed and it can be seen that there are a large number of possible predetermined combinations which can be obtained by using the six contacts on one hand of the control gloves and six contacts on a corresponding control glove on the opposite hand.

Thus, there has been illustrated and described a unique and novel jogging generator which fulfills all of the objects and advantages which have been sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A jogging-generator for use by a person to jog therein and generate an electrical current during a jogging activity, and which is immediately accessible from and to a dwelling structure, said jogging generator comprising:

a) support means located immediately adjacent the dwelling structure;

b) a drum-shaped exercise unit housing supported by said support means and sized so that a jogger can run therein;

c) bearing means associated within said drumshaped exercise unit housing;

d) an electrical generator;

e) means connected to said drum-shaped exercise unit housing for operating said generator during the running of the jogger within said drum-shaped exercise unit housing so as to produce electrical current from said generator; and f) access entrance and exit means on said drumshaped exercise unit housing affording immediately access to the exercise unit housing from the dwelling structure and to the dwelling structure from the exercise unit housing.

2. The jogging generator of claim 1 further characterized in that a rotatable ring member is operatively supported by said bearing means for rotation within said drum-shaped exercise unit housing.

3. The jogging generator of claim 2 further characterized in that a foot receiving section is on said rotatable ring member to receive and provide a comfortable position for the feet of the jogger, said foot receiving section being spaced around the entire circumference of said rotatable ring member.

4. The jogging generator of claim 1 further characterized in that a sheltered area extends from said dwelling structure to said exercise unit housing to protect the user from external environmental conditions.

5. A jogging generator for use by a person to jog therein and generate an electrical current during a jogging activity, said jogging generator comprising:

a) support means, b) a drum-shaped exercise unit housing supported by said support means and sized so that a jogger can run therein;

c) bearing means associated within said drumshaped exercise unit housing;

d) an electrical generator;

e) means connected to said drum-shaped exercise unit housing for operating said generator during the running of the jogger within said drum-shaped exercise unit housing so as to produce electrical current from said generator;

f) battery storage means for receiving the generated electrical energy for charging same;

g) AC-DC converter means for converting from AC to DC or DC to AC energy; and h) output means connected to said storage means and said convertor means to provide a battery source of power or AC or DC power.

6. The jogging generator of claim 5 further characterized in that a voltage regulator means receives the electrical current generated by said generator and regulates the voltage thereof.

7. The jogging generator of claim 5 further characterized in that a rectifier is interposed between said regulator means and said generator.

8. A jogging generator for use by a person to jog therein and generate an electrical current during a jogging activity, said jogging generator comprising:

a) support means;

b) a drum-shaped exercise unit housing supported by said support means and sized so that a jogger can run therein;

c) bearing means associated with said drum-shaped exercise unit housing;

d) an electrical generator;

e) means connected to said drum-shaped exercise unit housing for operating said generator during the running of the jogger within said drum-shaped exercise unit housing so as to produce electrical current from said generator; and f) control means operatively connected to said exercising unit housing for affecting one or more parameters associated with an exercising activity, and which control means is responsive to the jogging activity of a user of the jogging generator.

9. The jogging generator of claim 8 further characterized in that said control means comprises a sensor responsive to a physical characteristic of a jogger and which affects an amount of friction imposed on the exercise unit housing.

10. The jogging generator of claim 8 further characterized in that the control mans comprises a display member which depicts a condition of the jogging generator during a jogging activity.

11. The jogging generator of claim 10 further characterized in that the control means also comprises a device member for displaying the information unrelated to the jogging activity in the display member.

12. The jogging generator of claim 8 further characterized in that said control means comprises a manually actuable control device response to actuation by a jogger during a jogging activity.

13. The jogging generator of claim 12 further characterized in that the manually actuable control device is a glove having a plurality of switch contacts thereon which are operable in predetermined combinations.

* * * * *